United States Patent [19]

Swick, Jr.

[11] Patent Number: 4,576,312

[45] Date of Patent: Mar. 18, 1986

[54] FUEL DISPENSING STATION

[75] Inventor: George E. Swick, Jr., Muskegon, Mich.

[73] Assignee: Bennett Pump Company, Muskegon, Mich.

[21] Appl. No.: 591,000

[22] Filed: Mar. 19, 1984

[51] Int. Cl.[4] ..... B67D 5/06

[52] U.S. Cl. ..... 222/27; 235/144 R; D15/9.2; 222/173

[58] Field of Search ..... 222/25, 17, 26, 27, 222/28, 30, 35, 32, 144.5, 23, 135, 132, 129, 255, 252, 530; 361/428; 235/1 R, 144 R; 346/44; D15/9.2, 9.1, 9.3; D25/33; 312/215, 223, 242, 351, 290, 286

[56] References Cited

U.S. PATENT DOCUMENTS

| | | | |
|---|---|---|---|
| D. 262,115 | 12/1981 | Rowan et al. | D15/9.2 |
| D. 262,970 | 2/1982 | Rowan et al. | D15/9.2 |
| D. 262,971 | 2/1982 | Robinson et al. | D15/9.2 |
| D. 264,471 | 5/1982 | Rowan et al. | D15/9.2 |
| D. 272,630 | 2/1984 | Koppens | D15/9.2 |
| 1,887,088 | 11/1932 | Frank | 361/428 |
| 3,508,681 | 4/1970 | Fitzgerald | 222/30 |
| 3,763,401 | 10/1973 | Ransom | 361/428 |
| 3,995,769 | 12/1976 | Kuwabara et al. | 222/26 |

FOREIGN PATENT DOCUMENTS

| | | | |
|---|---|---|---|
| 0001515 | 1/1977 | Japan | 222/27 |

OTHER PUBLICATIONS

Gilbarco publication of "Multi-Product Dispenser"; 8 pages (note p. 4).

Calcutron; "The Advanced Electronic Self-Service Fueling System from Europe's Leader . . . "; Copyright 1980 plus 9 pages.

Tokheim Creates the MMD—5 pages; Jan. 11, 1981.

*Primary Examiner*—Joseph J. Rolla

*Assistant Examiner*—Kenneth Noland

*Attorney, Agent, or Firm*—Price, Heneveld, Huizenga & Cooper

[57] ABSTRACT

A fuel dispensing unit has a structure providing a plurality of dispensing hoses on each of two sides for dispensing one or more kinds of fuel. The unit has a closed cabinet in its lower portion containing the fuel handling equipment and a pair of vertical hollow end standards, one on each of the opposite ends of the cabinet. A trough interconnects the tops of the standards leaving an open space between the trough and cabinet in which a display unit is mounted to display information on price, volume, etc. All fuel handling equipment is confined to the cabinet, one end standard and the trough. All electrical and microprocessor facilities are confined to the other standard and are sealed from the cabinet, trough and the one end standard.

13 Claims, 17 Drawing Figures

FUEL DISPENSING STATION

BACKGROUND OF THE INVENTION

The present invention relates to gasoline station fuel dispensers, particularly to multiple fuel dispensing units having a plurality of dispensing hoses for dispensing gasoline or diesel fuel.

A typical gasoline dispensing island has a plurality of "pumps" for dispensing several different fuel grades and types. A dispensing unit of this invention should be contrasted with the standard gasoline station "pump" which has only one or two dispensing hoses which may or may not dispense more than one grade or type of fuel.

In multiple dispensing units, at least one dispensing hose is sometimes provided for unleaded fuel, another for leaded fuel and so on. Each of these hoses is typically provided with its own metering device and appurtenant electronic controls. Fuel pumps are either located within the dispensing unit or at a location remote from the dispenser. One or more display panels are provided to allow the user to monitor the quantity and cost of the gasoline dispensed. In a few designs, the dispensing hoses depend from a portion of the dispenser above the level of the automobile so that the dispensing tubes can easily reach across the width of a standard car without causing the hose to become tangled with the car's bumper or caught underneath the car.

It is desirable to make a dispenser as compact as possible so that it will require as little space as possible at a gas station, where space is often at a premium. Compactness, however, tends to make it difficult to service such dispensers inasmuch as the operative components, such as pumps, fuel conduits and electronic controls inside the dispenser, are positioned closely together. This makes it difficult to reach some components with tools or testing equipment. Not infrequently, one component may have to be removed to service another.

In addition, the compactness makes it more difficult to design to satisfy safety standard requirements. It is required to isolate the electrical and flammable liquid systems from one another as much as possible. The slightest leak from the fuel system can be ignited by a spark from the electrical system, particularly if the dispenser has chambers which trap explosive gases, such as those evaporating from gasoline. Positioning the operative electrical and hydraulic components close together, of course, makes it more difficult to avoid defeating this safety feature.

SUMMARY OF THE INVENTION

The present invention is a fuel dispensing unit having plural dispensing hoses on each of two faces having two spaced, upstanding standards, each standard having a vertical passage and a removable cover. A housing is positioned between the lower portions of the standards for housing a meter and fuel supply means for each dispensing hose. A header extends between the upper portions of the standards and is rigidly connected to the standards. The dispenser hoses depend downwardly from the header. A conduit extends from each meter to a dispenser hose from the housing through one of the vertical passages and into the header. The meter housing, the enclosure containing the conduits and the header are isolated and sealed from the other enclosure to isolate the other enclosure from fuel vapors. The other enclosure is an isolated compartment for wiring and electronic controls for the pumps.

In narrower aspects of the invention, the two enclosures, the header and the pump housing have individual removable access panels. Thus, while the operative components of the dispenser inside the dispenser can be closely positioned with respect to one another within each of the compartments defined by the standards, the housing and the header, no servicing problems are posed because the access panels can quickly be removed providing ready access to the components within each compartment. The invention permits the combination of a compact design with effective isolation and separation of electrical control apparatus and flammable vapor sources.

DETAILED DESCRIPTION OF THE PREFERRED EMBODIMENT

Figure 1:
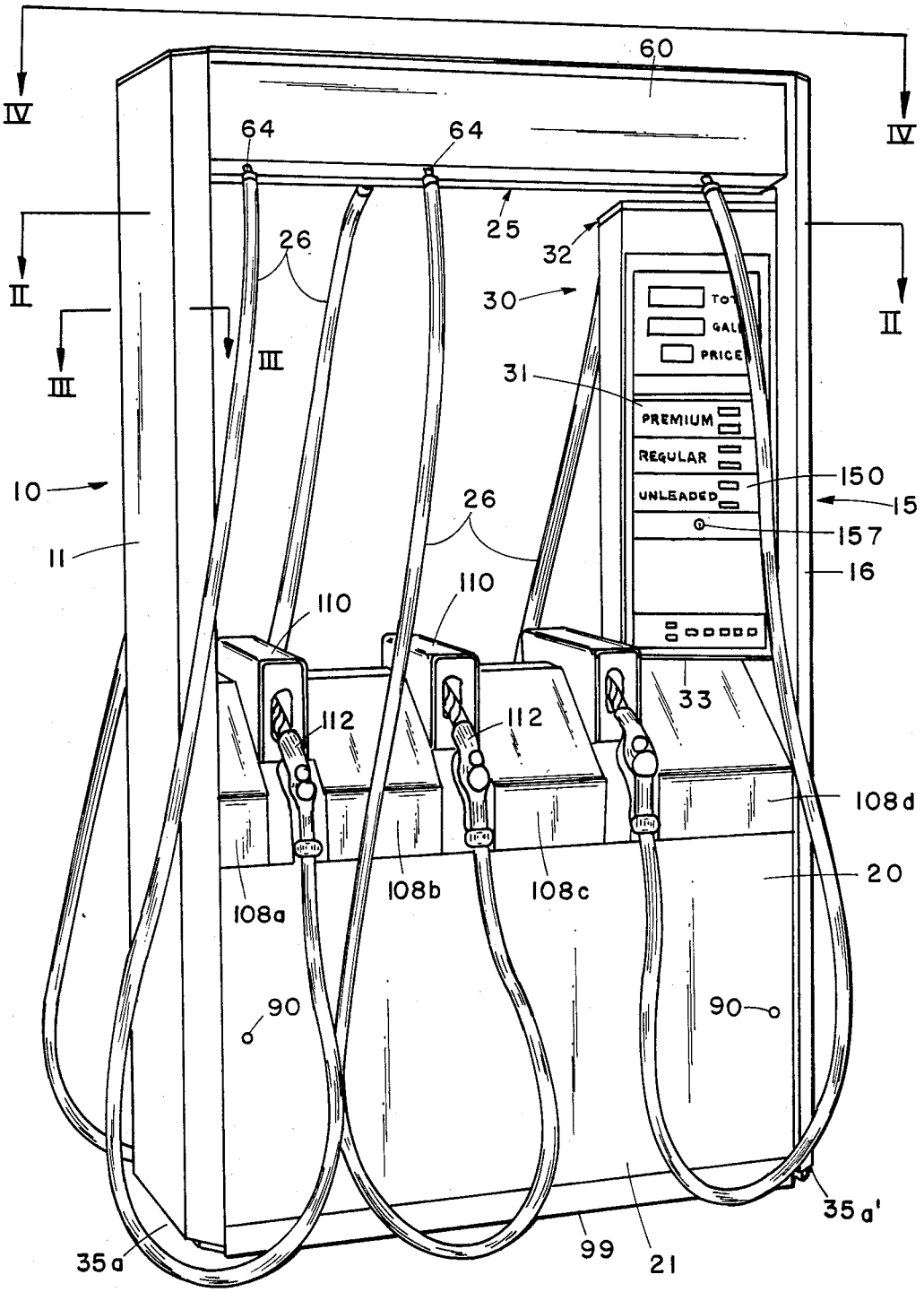
FIG. 1 is a perspective view of the fuel dispensing unit of the present invention.

A preferred embodiment of the present invention comprises two spaced upstanding end standards or supports 10, 15, each of which is covered by an enclosure panel 11, 16, respectively. A housing 20 (FIG. 1) is provided for enclosing the hydraulics compartment. The hydraulic compartment may contain both metering and pumping equipment. Normally, this compartment is equipped only with metering and valving equipment and also includes certain electronic switching and telemetering devices in explosion-proof packages and such is the construction illustrated. Accordingly, hereafter, it is called the metering chamber. The metering chamber 23 (FIG. 12) is disposed between the lower portions of the two upstanding supports and is covered by two access panels 21, one on each face of the dispenser. Only one access panel 21 is shown in FIG. 1, it being understood that the opposite face of the dispenser is a mirror image of the side shown. A bridge or header 25 is positioned between and structurally connects the upper portions of the two upstanding supports. Six dispenser hoses 26 depend from header 25. A control cabinet 30 is positioned between the header and meter housing and is mounted to end support 15. The compartment 23 houses individual meters 22 for each of the hoses 26. If the dispensing unit also provides a pump or pumps, it will also be housed in the compartment 23.

It will be recognized that with a dispenser of this type, the fuel for all of the hoses can be pumped at a facility remote from the dispenser with only metering performed at the dispenser. Normally one pump is provided by each two hoses and different pumps for each type of fuel. It will also be recognized that providing six dispensing hoses 26 is a design choice based upon expected usage and fewer or more hoses could be provided and the overall structure of the dispenser sized accordingly.

Figure 4:
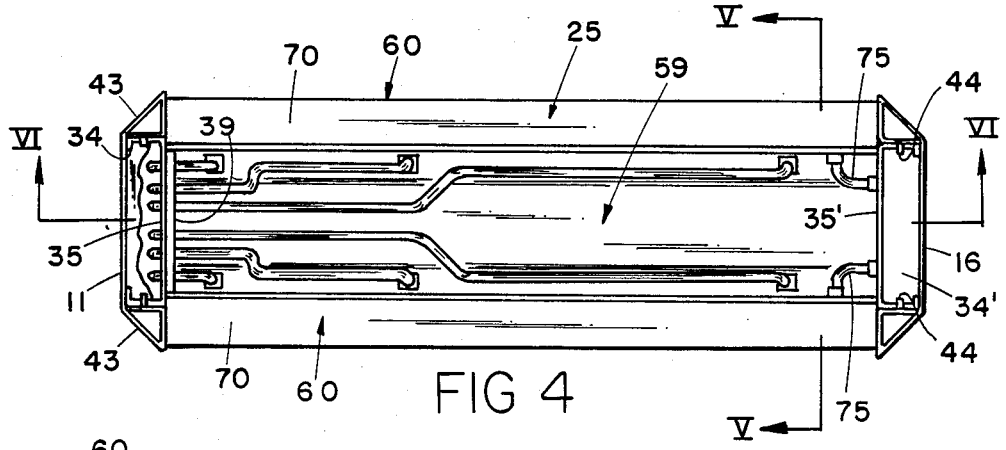
FIG. 4 is a top view of the fuel dispensing unit of the present invention with the top covers removed.
Figure 7:
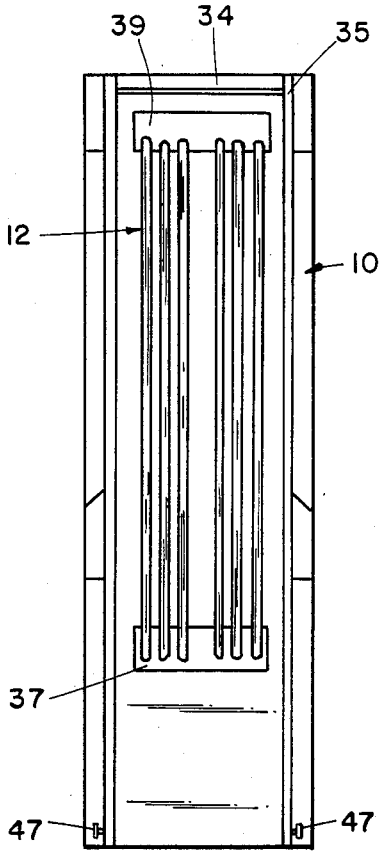
FIG. 7 is a side elevation of the fuel dispensing unit of the present invention viewed from the left side of FIG. 1 with a side access panel removed.

A conduit 12 (FIG. 7) connects each meter 22 with an individual dispenser hose 26, the conduits 12 extending through upstanding support 10 (FIG. 7) and into the bridge 25 (FIG. 4). The electronic controls for the dispenser are isolated from conduits 12 and the pump and metering chambers 23. These controls are located in upstanding end support 15 and in control cabinet 30 (FIG. 8) and include a microprocessor device 17 with appurtenant wiring 18.

Figure 3:
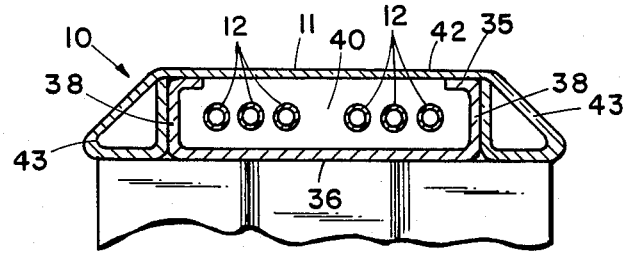
FIG. 3 is an enlarged cross section taken along the plane of line III—III of FIG. 1.

Upstanding end support 10 comprises an elongated, upright C-shaped channel 35 (FIGS. 3 and 7) which has an opening 37 through which conduits 12 enter into C-shaped channel 35 from metering chamber 23. An opening 39 is provided through which conduits 12 pass from C-shaped channel 35 to bridge 25 (FIG. 4).

Figure 15:
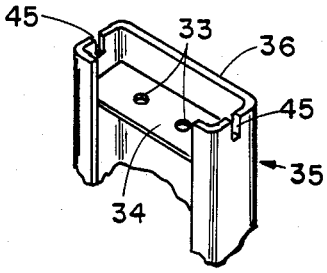
FIG. 15 is a fragmentary, exploded perspective view of the top of one of the upstanding supports of the fuel dispenser.

C-shaped end channel 35 comprises a central web 36 and two outwardly projecting flanges 38. The web 36 and flanges 38 define a passage 40 through which the conduits 12 extend. The upper ends of the channels 35 are closed by plates 34 (FIG. 15) welded to the channels. The plates are provided with holes 33 for installation of eyebolts for lifting the dispenser during transport and installation.

Figure 9:
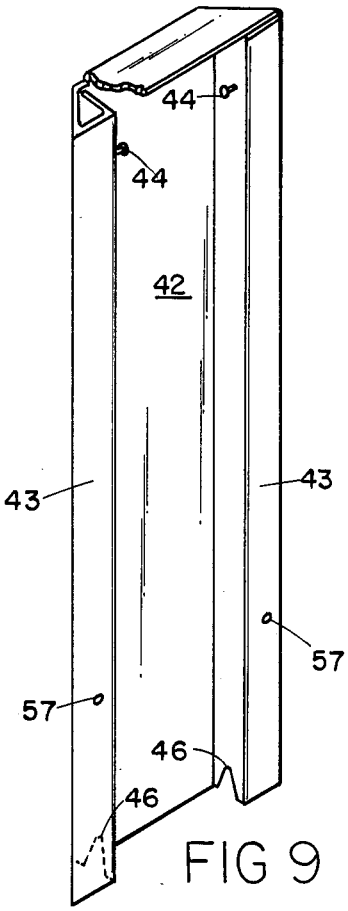
FIG. 9 is a partially broken perspective view of a side access panel as seen from the inside.

End support 10 further includes an enclosure panel 11. The enclosure panel 11 has an elongated central web 42 and a pair of dress flanges 43 disposed along opposite edges of the central web 42 (FIG. 9). The dress flanges 43 are delta shaped in cross section for aesthetic and other reasons which will become apparent and act as stiffeners for the panels.

Figure 10:
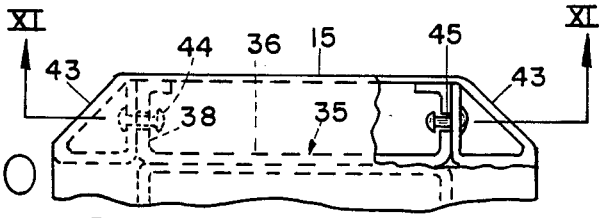
FIG. 10 is an enlarged top view of one of the standards with one corner side broken out.
Figure 11:
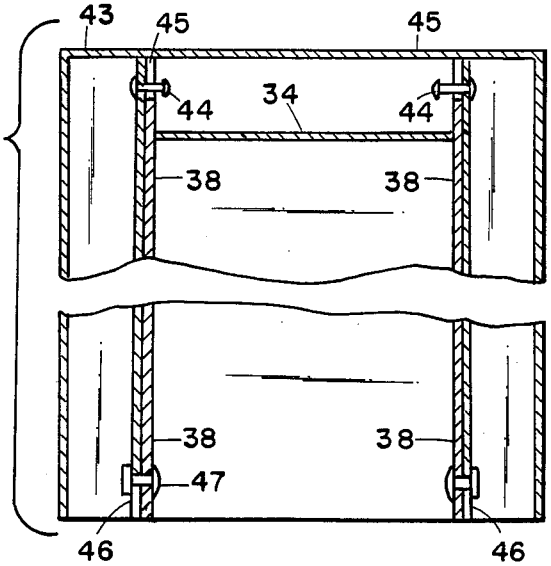
FIG. 11 is a partially broken cross section taken along the plane of line XI—XI of FIG. 10.

End enclosure panel 11 is secured to channel 35 at both the upper and lower ends of the panel. At the upper end of panel 11, a stud 44 is mounted on and projects inwardly from the inside surface of each dress flange 43 (FIGS. 9 and 10). Thus, the two studs 44 face each other. The upper end of end channel 35 is provided with a pair of notches 45 (FIGS. 11, 15) which open through the top of outwardly projecting flanges 38. As shown in FIGS. 10 and 11, the studs 44 become seated in the notches 45 as side enclosure panel 11 is lowered downwardly onto channel 35.

At the lower end of enclosure panel 11, two downwardly opening, tapered notches 46 (FIG. 9) are provided. These notches open through the bottom edges of dress flanges 43. Notches 46 engage a pair of outwardly projecting studs 47 secured to flanges 38 of channel 35 (FIGS. 7, 8 and 11) near the bottom of flanges 38. Therefore, as panel 11 is lowered downwardly over channel 35, studs 47 will engage notches 46 and studs 44 will engage notches 45 (FIGS. 9 and 10), preventing both horizontal and downward movement of panel 11 with respect to channel 35. Panel 11 can also be locked against upward movement relative to channel 35 by means to be described below.

Figure 8:
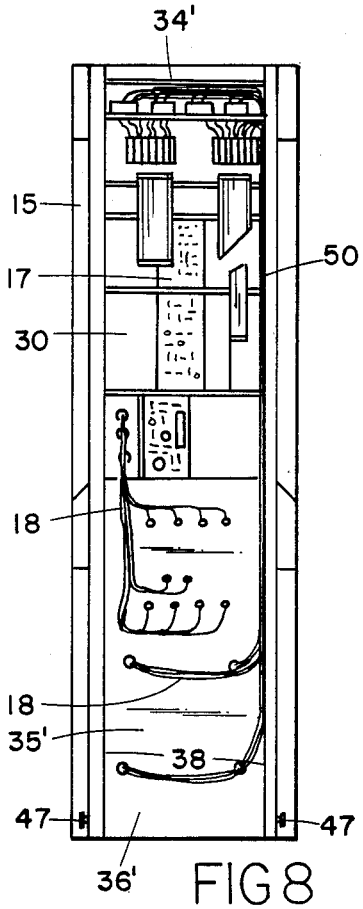
FIG. 8 is a side elevation of the fuel dispensing unit of the present invention from the right side of FIG. 1 with a side access panel removed.

Upstanding end support 15 is virtually identical to end support 10 with the exception of a few particulars. End support 15 also includes a C-shaped channel 35' having a central web 36' and outwardly projecting flanges 38' (FIG. 8). A large opening 50 in central web 36' provides access to the interior of control cabinet 30 and to microprocessor unit 17 housed in control cabinet 30. A number of smaller openings are provided through web 36' for the passage of electrical wiring to the pumps, the pump activation switches (to be described below) and the light housings 60. All openings through the web 36' communicating with the metering chamber are provided with gas tight seals to provide a vapor barrier.

End support 15 is also provided with an enclosure panel 16 identical to enclosure panel 11. Enclosure panel 16 is mounted on channel 35' in exactly the same fashion as panel 11 is mounted on channel 35. The same notches and studs are provided in panel 16 and channel 35' as in panel 11 and channel 35, so no further detailed description of panel 16 and channel 35' is deemed necessary.

Both panels 11 and 16 are slightly shorter than the channels on which they are mounted. This leaves gaps **35*a*, 35*a'* at the bottoms of supports 10 and 15 (FIG. 1). Since panels 11 and 15 are open at their bottoms and channels 35, 35' are open between their outwardly projecting flanges, any fuel vapor which accumulates in the supports will spill out of supports through gaps 35*a*, 35*a'*** because it is heavier than air. Thus, the likelihood of fuel vapor reaching a sufficient concentration to ignite in the air within upstanding supports is reduced.

Figure 16:
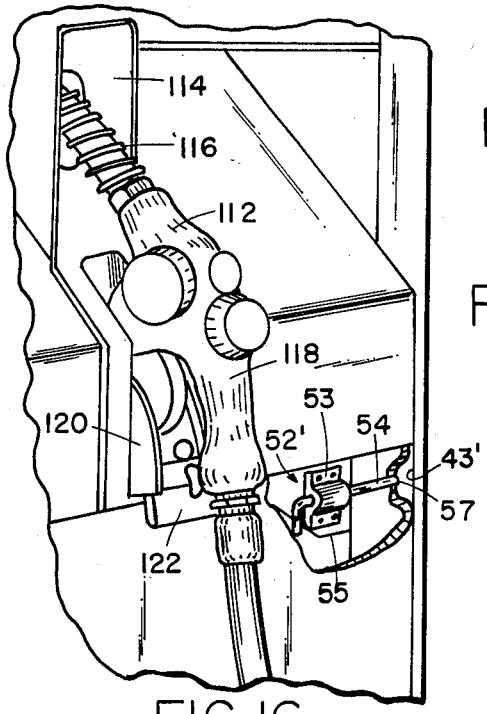
FIG. 16 is a detailed, partially broken perspective view of a latch used to lock the side enclosure panels.

Once panels 11 and 16 are mounted on channels 35, 35', respectively, they can be locked against upward movement by latches 52, 52' (FIGS. 12, 16) which are located behind and accessible only when face panel 21 is removed. Latches 52, 52' are identical, so only one will be described. As shown in FIG. 16, latch 52' comprises a bracket 53 slidably supporting a dead bolt or slidable latch bolt 54. Bracket 53 is secured to a gusset 55 which joins channel 35' and a horizontal frame member 56. Latch 52' is disposed such that latch bolt 54 is slidable horizontally. A latch hole 57 is provided in dress flange 43' of side panel 16 to receive latch bolt 54. When latch bolt 54 extends through hole 57, vertical movement of enclosure panel 16 is prevented and the side enclosure panels cannot be removed. One of the latches is provided for each end panel. This is adequate to prevent unauthorized removal of the end panels. However, if further security is desired, such latches can be provided behind the panels on both faces of the pump chamber 23. The functional purpose of dress flanges 43 should be apparent. Because each of them is turned inwardly on itself, each provides a barrier against vandals tampering with the latches 52, 52' and the studs 44, 47 which lock panels 11 and 16 in place.

Figure 5:
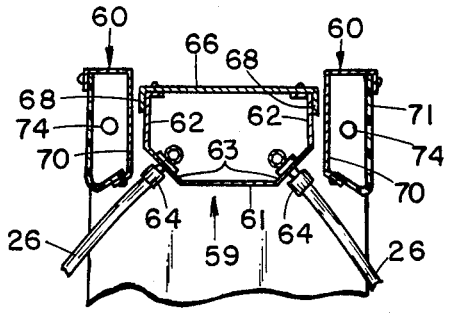
FIG. 5 is a cross section taken along the plane of line V—V of FIG. 4.

Bridge 25 extends between the upper portions of upstanding supports 10 and 15 and includes a trough 59 and two light housings 60 (FIGS. 4 and 5). Bridge 25 is secured to both end supports and provides a rigid connection between them. It thus provides a structural stabilizer for the dispenser. As shown in FIG. 4, trough 59 houses the upper horizontal portions of conduits 12 which communicate with dispenser hoses 26. Trough 59 includes a flat horizontal bottom 61 and two vertical side panels 62. Two angled panel portions 63 connect bottom 61 with the side panels 62. Angled panel portions 63 also mount the hose couplings 64 (FIGS. 1 and 5) which connect the dispenser hoses 26 to the conduits 12. As shown in FIG. 5, angled panel portions 63 bias the tubes 26 away from the side of the dispenser. This reduces the tendency to become twisted in use and makes it easier to position and remove the nozzles from their storage seats because it reduces resistance to their alignment with their seats.

Figure 6:
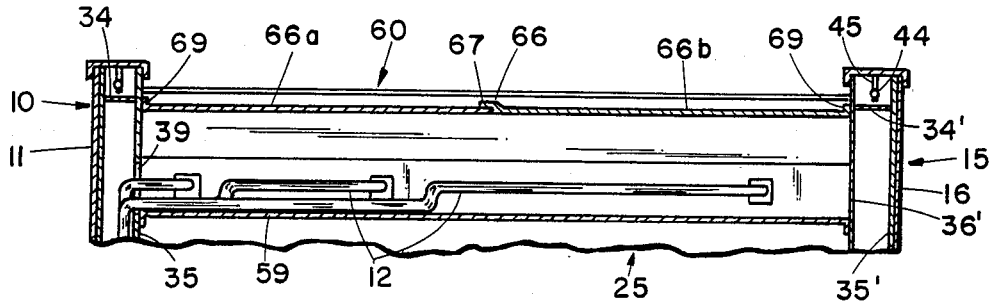
FIG. 6 is a fragmentary cross section taken along the plane of line VI—VI of FIG. 4.

As shown in FIGS. 5 and 6, trough 59 also has a split cover 66 made of two portions **66*a* and 66*b*. Cover portion 66*b* includes an overlapping flange 67 which shields the gap between the two cover portions. Each cover portion is provided with downturned edge flanges 68 (FIG. 5) which seat over the side panels 62 between the panels 62 and the back of light housings 60. Each cover portion also has an upturned end flange 69 (FIG. 6) which abuts against adjacent upstanding supports 10 or 15**.

Each light housing 60 is positioned parallel to trough 59 but spaced therefrom a short distance, as shown in FIGS. 4 and 5. This provides a positive air gap between the bridge and the lights. This spacing avoids the possibility of volatile fumes entering the light housing where they could be ignited by the electrical equipment therein.

Because trough 59 communicates with upstanding support 10 through opening 37 (FIG. 4), any vapors which accumulate in trough 59 due to small fuel leaks will spill into the hollow interior of support 10 because fuel vapors are heavier than air. As noted above, any fuel vapors which accumulate in support 10 escape through gap **35*a***.

However, no openings between support 15 and trough 59 are provided to prevent such vapor from entering support 15 from trough 59. Similarly, no direct openings between pump housing 20 and support 15 exist for the same reason. Small holes are provided in web 36' of support 15 to allow wires to pass from support 15 to housing 20 for meters 22. However, these wires are sealed within electrical conduits 79 (FIG. 12), each of which has a vapor-tight seal at the point where it passes through web 36'.

Each light housing 60 is secured at its ends to channels 35, 35', as shown in FIG. 4. Housing 60 has a metal member 70 which forms the back and top of the light housing and a translucent panel 71 which forms the front and bottom of the light housing (FIG. 5). The ends of the light housing are closed. The housing 60 contains a fluorescent light source 74. Power is supplied to lights 74 by wires which extend above trough 59 enclosed in airtight electrical conduits 75, as shown in FIG. 4. With this arrangement, light housings 60 and their appurtenant electrical supply means are isolated from trough 59 to prevent diffusion of any vapors from the trough into the lighting fixture housings 60.

Meter chamber 23 is enclosed by housing 20 which has oppositely facing access panels 21, only one of which is shown, as indicated above. Six meters 22 are contained within pump housing 20, only three being shown in FIG. 12. The other three meters are accessible through and located behind the access panel on the opposite face of the machine. Each meter includes a positive displacement cylinder-piston assembly and a valve assembly and telemetering device 3. Each meter 22 communicates electrically with the microprocessor and activation switches by wires which are contained within vapor-tight electrical conduits (not shown). The construction and operation of the meters is not part of this invention.

The meters are supported in pairs on support platforms 80 which are mounted to a support frame 81.

Figure 12:
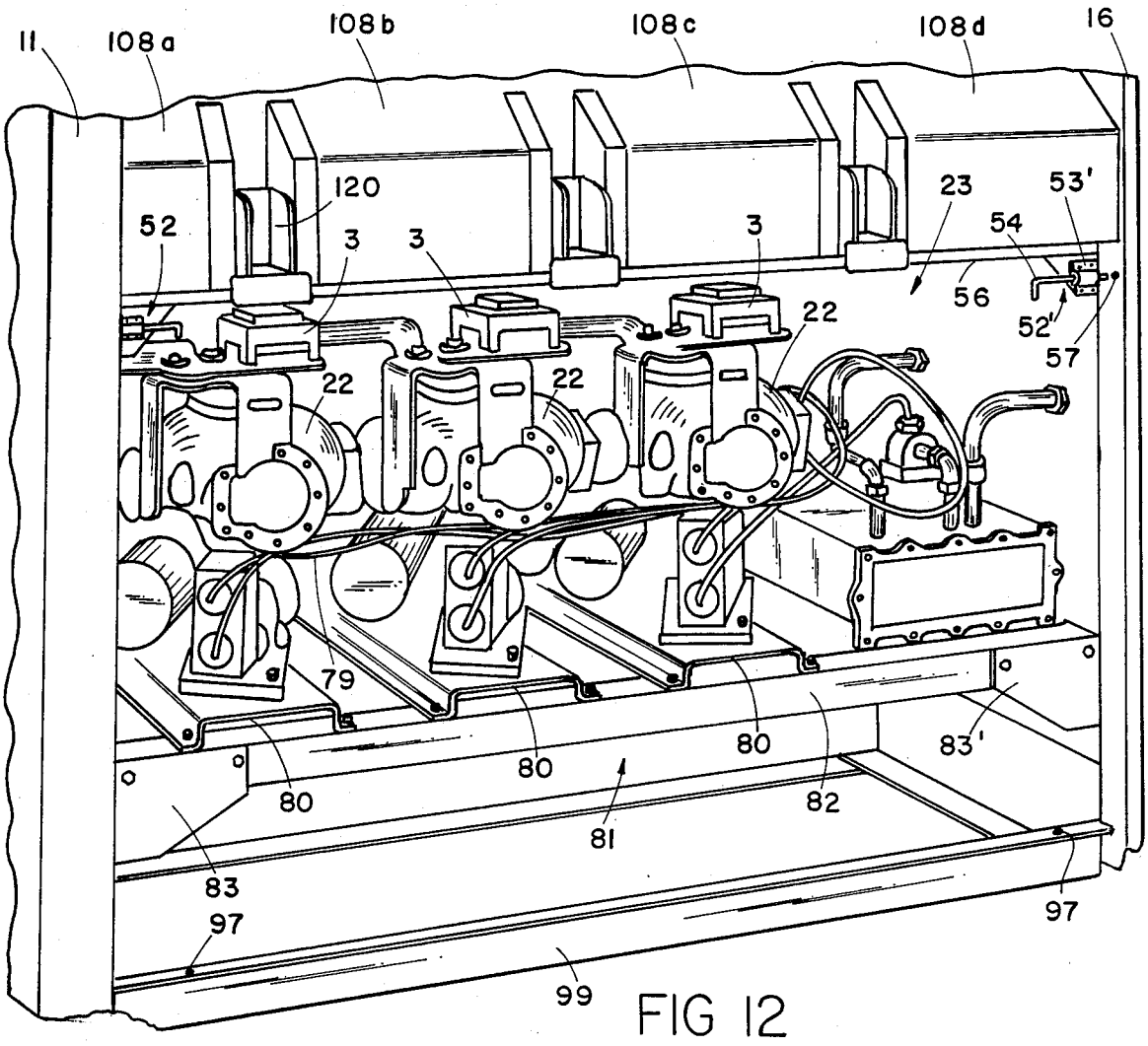
FIG. 12 is a detailed perspective view of the metering chamber housing for the present invention with the face access panel removed.

Support frame 81 includes two elongated frame members 82, only one of which is shown in FIG. 12. The other is positioned on the other side of the dispenser, being a mirror image of the one shown in FIG. 12. Frame members 82 are supported by gussets 83, 83' which in turn are secured to channels 35, 35', respectively.

Face panel 21 extends across one face of the pump housing 20. Panel 21 has two key operated locks 90. Only one of these assemblies will be described.

Figure 14:
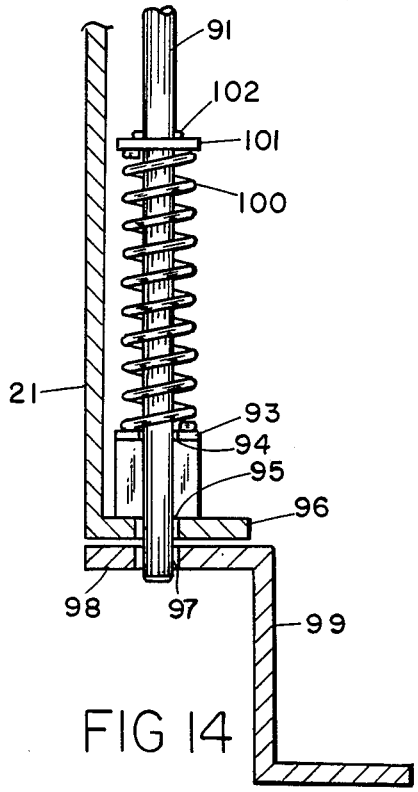
FIG. 14 is an enlarged fragmentary, sectional view taken along the plane of line XIV—XIV of FIG. 13.

As can be seen from the rear of access panel 21 when mounted (FIG. 13), each lock 90 is connected to a lock slide 91 by a short link arm 92. One end of link arm 92 is fixedly secured to the tumbler mechanism of lock 90, and the other end of arm 92 is pivotally secured to lock slide 91. Lock slide 91 extends downwardly through a hole 94 in the lock slide guide bracket 93. Guide bracket 93 serves as a guide and support for lock slide 91 when it is moved into and out of a small hole 95 in the inwardly projecting flange 96 of lower panel 21 and a mating hole 97 through an outwardly projecting flange 98 of a base support frame member 99 (FIG. 14). Frame member 99 extends across the front of the dispenser at the bottom thereof and has a Z-shaped cross section, as shown in FIG. 14. There is a second frame member 99 on the opposite side of the dispenser, the second member 99 being a mirror image of the one shown.

Figure 13A:
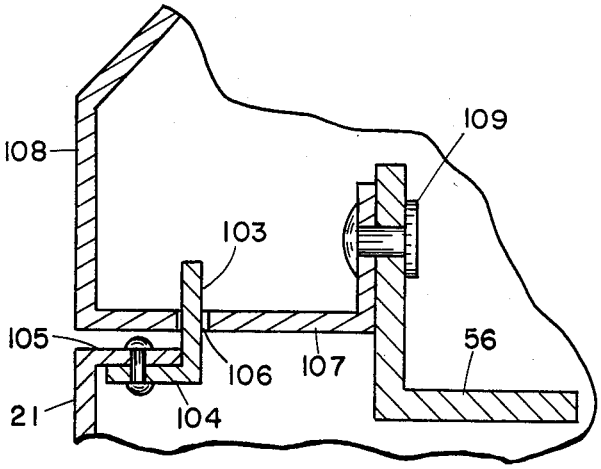
FIG. 13*a* is an enlarged, fragmentary, sectional view taken along the plane of line XIIIA—XIIIA of FIG. 13.
Figure 13:
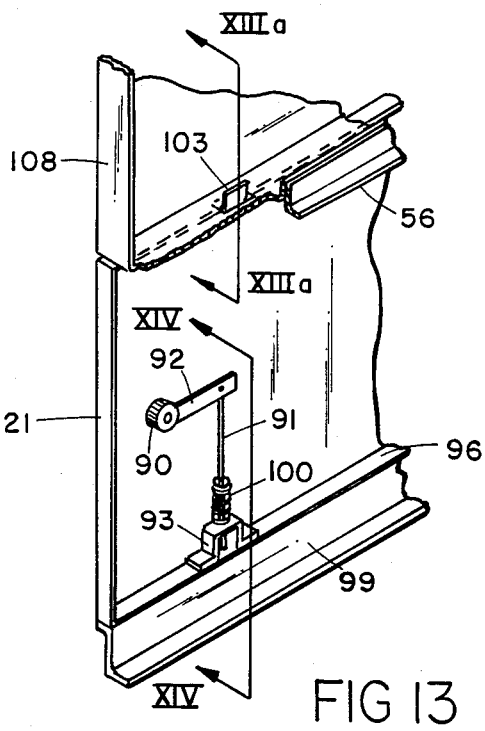
FIG. 13 is a fragmentary, inside perspective view of a face panel for a fuel pumping and metering compartment of the present invention illustrating a locking mechanism securing the face panel to the dispenser.

The upper part of the front panel 21 is held securely in position across pump housing 20 by tabs 103, one of which is positioned above each lock 90 (FIG. 13). As shown in detail in FIG. 13A, tab 103 has a foot 104 secured to an inwardly projecting flange 105 extending across the upper edge of panel 21. Tab 103 projects upwardly from the rear edge of flange 105 and is received within a slot 106 in an inwardly projecting portion 107 of shroud **108*a* on the top of pump housing 20. Shroud 108*a* is secured to frame member 56 by fastener 109, as shown in FIG. 13A. When tab 103 is inserted into slot 106, the upper portion of panel 21 will be locked against horizontal and vertical movement, provided that the lower edge of panel 21 rests upon Z-shaped frame member 99, as shown in FIG. 13. It should be understood that even though only one tab 103 is illustrated in FIGS. 13 and 13A, at least two such tabs should be provided along the upper edge of panel 21. It is preferable to have a tab 103 above each of the locks 90 projecting into slots in shrouds 108*a* and *d*. However, additional tabs may be positioned between locks 90 along the upper edge of panel 21**, as well.

To remove access panel 21, lock 90 is released by a key from its locked position illustrated in FIG. 13 and a spring 100 disposed between guide bracket 93 and a washer 101 urges lock slide 91 out of holes 95 and 97. Washer 101 biases spring 100 against guide bracket 93 and is held in position on lock slide 91 against upward movement thereon by means of pin 102 in lock slide 91. The bottom part of panel 21 is pulled outwardly and the top is lowered so that tabs 103 are removed from slots 106.

Figure 2:
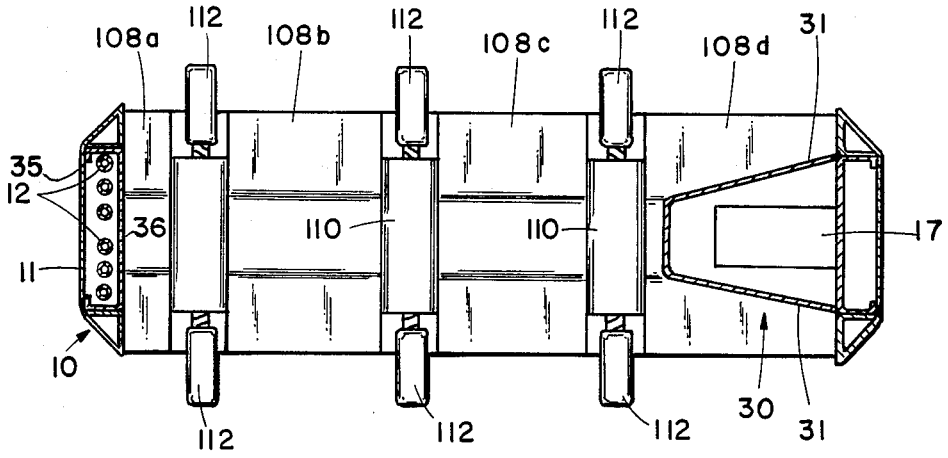
FIG. 2 is a cross section taken along the plane of line II—II of FIG. 1.

Shrouds 108*a–d* provide the top of meter housing 20 and extend from one face of the dispenser to the other and close the top of the pump chamber 23, as shown in FIGS. 1 and 2. Shrouds 108 are alternated with casings 110 for dispenser nozzle storage. As shown in FIG. 2, each casing 110 stores two nozzles 112, one on each of the opposite sides of the dispenser unit. Each casing has a hood 114 which receives the spout 116 of a nozzle 112 (FIG. 16). Nozzle 112 is provided with a handle 118 which rests in a stirrup 120 recessed into the casing 110. A conventional activation lever 122 is positioned at the bottom of stirrup 120 and is movable upon nozzle removal to activate the appropriate pump. Nozzles 112 and activation lever 122 are conventional and well known in the art.

When nozzles 112 are mounted in nozzle holders, as shown in FIG. 1, the dispenser hoses 26, which depend slightly outwardly and generally downwardly from trough 59, will rest substantially flush with the plane of front panel 21. Therefore, there is little likelihood that a hose will catch on the bumper of a passing car and be pulled from the dispenser. This safety feature is enchanced since only a short section of each hose rests upon the ground at its lowermost point when the nozzle is in the holder, as shown in FIG. 1.

Control cabinet 30 is positioned between bridge 25 and pump housing 20. Control cabinet 30 is secured to and supported by channel 35' (FIG. 2). Access to cabinet 30 is provided through opening 50 in channel 35'. Cabinet 30 has two product display panels 31 (FIG. 2), one facing each face of the dispenser. Cabinet 30 has a top panel 32 (FIG. 1) which extends across the top of cabinet 30 and physically separates it from bridge 25. A gap is provided between the top of cabinet 30 and the bottom of bridge 25 to increase further the physical separation of bridge 25 from cabinet 30. The gap and top panel 32 form a barrier against fuel vapor leakage from trough 59 to cabinet 30.

A bottom panel 33 closes the bottom of control cabinet 30. A gap is provided between panel 33 and shroud 108*d* to eliminate possible vapor transfer. Thus, the cabinet is isolated from all parts of the dispenser in which there is any possible source of flammable vapors. Yet its internal equipment is readily accessible through both faces and the end panel.

The control cabinet 30 in horizontal section is trapezoidal in shape, thus providing displays on both faces which are readily visible to the customer irrespective of the hose being used. Also, this partially recesses the displays into the dispenser making it easier to read the displays despite the effects of incident light. The construction of the cabinet provides a compact, self-contained control and display center completely isolated from sources of explosive vapors. When changes must be made to the displayed information, such as price changes, access to the facilities for making the changes is provided by removal of the panel 150 covering the display face of the cabinet (FIG. 1). This panel is preferably secured by an appropriate lock 157. This arrangement provides ready accessibility and good visibility of the components to be worked on.

It can be seen from the above that the electrical components are physically isolated from the hydraulic components of the fuel dispensing unit. Therefore, the risk of fire is greatly reduced. Furthermore, the internal components of the fuel dispensing unit are easily accessible since much of the "skin" of the fuel dispensing unit can be removed in panel-like sections which reveal virtually all of the components within the fuel dispensing unit for easy service and access. Finally, the panels are easy to remove. By turning two keys, each of the face panels can be removed. Once the face panels are removed, the end access panels can quickly be removed simply by disengaging several simple latches and lifting the panels upwardly and away from the dispensing unit. The trough panels are also quickly removed by removing a few screws.

It is understood that the preceding description is that of the preferred embodiment of the invention and that various changes and alterations may be made without departing from the principles of the invention.

The embodiments of the invention in which an exclusive property or privilege is claimed are defined as follows:

1. A fuel dispenser having plural dispensing hoses on each of two faces, said dispenser having a pair of spaced, upright end standards, means for metering and supplying fuel and a housing enclosing said metering means in a chamber positioned between and rigidly connected to the lower portions of said standards; a hollow header extending between and rigidly connected to the tops of said end standards; each of said end standards being formed to provide a vertical passage and a removable cover to enclose the same; fuel dispensing hoses depending from each face of said header; fuel conduits connecting each of said hoses to said metering means, all of said conduits extending upwardly through one of said end vertical passages; an electrical power supply for said metering means and electrical conductors therefor; the conductors for said electrical power supply being located in the vertical passage of the other end standard and said passage in said other standard being isolated and sealed from said chamber, said first passage and said header.

2. The fuel dispenser as recited in claim 1 which further comprises at least one removable panel across an opening to said housing and locking means operably connected with said standards for locking said vertical passage covers, said locking means being located behind said panel and accessible from the outside of said dispenser only when said panel is removed.

3. The fuel dispenser recited in claim 2 wherein interengaging locking means are provided on said standards and removable covers, said locking means engaging upon downward sliding movement of the covers; means mounted internally of said chamber for detachably engaging said covers and holding them against sliding movement.

4. The fuel dispenser as recited in claim 2 wherein each vertical passage cover is connected to its standard such that said cover is removable by urging it upwardly on its standard, and said cover locking means releasably prevents said upward movement.

5. The fuel dispenser as recited in claim 4 wherein said cover locking means comprises for each panel a bolt having a slide therein, which slide is received within a hole in said cover to prevent said upward movement when said slide is positioned within said hole, said bolt being movable to a position where it is not positioned within said hole, permitting upward movement of said cover, said bolt being operatively connected to said standard.

6. The fuel dispenser as recited in claim 5 which further includes locking means to lock said access panel over said opening.

7. The fuel dispenser as recited in claim 6 wherein each cover is connected at its top and bottom to its standard by studs fixed to one of said cover and said standard, said studs being received within slots in the other of said cover and standard.

8. The fuel dispenser as recited in claim 7 wherein each cover is provided with at least one dress flange which shields said bolt hole, said slots and said studs against access from the outside of said island.

9. The fuel dispenser as recited in claim 7 which further includes at least one light assembly disposed alongside and parallel to said trough; said assembly having a housing spaced from said trough to prevent the diffusion of vapors from said trough into said housing, and lighting means within said housing.

10. The fuel dispenser as recited in claim 1 wherein said header comprises a trough having a bottom and upstanding sides for receiving said conduits, and a removable access cover extending across said sides to cover said conduits in said trough.

11. The fuel dispenser as recited in claim 1 wherein said covers are shorter than said standards and positioned on said standards such that gaps are created between the bottoms of said panels and the surface on which said dispenser is mounted, said gaps establishing communication between said vertical passages and the exterior of said dispenser preventing the accumulation of vapor within said passages.

12. The fuel dispenser as recited in claim 11 which further includes a plurality of shrouds which cover the top of said metering housing, a plurality of casings disposed alternatingly with said casings on the top of said metering housing, and a nozzle for each of said hoses, said nozzles being received within and supported by said casings when not in use.

13. A fuel dispenser having a pair of faces and a pair of upright end members, a trough like header member secured to and rigidly interconnecting said end members, a plurality of fuel dispensing hoses depending from a face of said header member; means interconnecting the lower portions of said end members and enclosing an hydraulic equipment chamber; said end members each being hollow and providing a vertical internal passage; fuel supply means in said hydraulic equipment chamber and fuel conduits connecting said supply means to said dispensing hoses, all of said conduits being housed in the passage of one of said end members; electrical supply, control and monitoring means connected to said fuel supply means; electrically powered display means connected to the other of said end members; a cabinet for said display means; said cabinet being of trapezoidal shape in horizontal section and secured to said other end member, closed at top and bottom, extending over said hydraulic equipment chamber and spaced from both said header and said hydraulic equipment chamber; electrical conductor members interconnecting said fuel supply means with said electrical supply, control, monitoring and display means, all of said electrical conductor means being housed in the passage of the other of said end members, said passage in said other end member being isolated from said hydraulic equipment chamber, header member and one end member; a pair of elongated illumination members mounted to and extending between said end members, one on each side of said trough, each of said illumination members having a housing spaced from said trough to provide an air gap between them and sealed from said passage in said one end member.

* * * * *